US009650851B2

(12) United States Patent
Whitsitt et al.

(10) Patent No.: US 9,650,851 B2
(45) Date of Patent: May 16, 2017

(54) AUTONOMOUS UNTETHERED WELL OBJECT

(71) Applicant: Schlumberger Technology Corporation, Sugar Land, TX (US)

(72) Inventors: John R. Whitsitt, Houston, TX (US); John A. Booker, Missouri City, TX (US); Thomas Daniel MacDougall, Sugar Land, TX (US); Gary L. Rytlewski, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 809 days.

(21) Appl. No.: 13/916,657

(22) Filed: Jun. 13, 2013

(65) Prior Publication Data

US 2014/0076542 A1 Mar. 20, 2014

Related U.S. Application Data

(60) Provisional application No. 61/660,964, filed on Jun. 18, 2012, provisional application No. 61/713,743, filed on Oct. 15, 2012.

(51) Int. Cl.
*E21B 23/00* (2006.01)
*E21B 34/14* (2006.01)
(Continued)

(52) U.S. Cl.
CPC ..... *E21B 23/00* (2013.01); *E21B 34/14* (2013.01); *E21B 47/0905* (2013.01); *E21B 43/14* (2013.01); *E21B 2034/007* (2013.01)

(58) Field of Classification Search
CPC ..... E21B 23/00; E21B 34/14; E21B 43/14; E21B 47/09; E21B 47/0905; E21B 2034/007
(Continued)

(56) References Cited

U.S. PATENT DOCUMENTS 2,223,442 A 12/1940 Crowell
2,316,643 A 4/1943 Yule
(Continued)

FOREIGN PATENT DOCUMENTS

CA 2529962 C 7/2009
EP 2372080 A2 10/2011
(Continued)

OTHER PUBLICATIONS

McDaniel, "Review of Current Fracture Stimulation Techniques for Best Economics in Multi-layer, Lower Permeability Reservoirs", SPE 98025—SPE Eastern Regional Meeting, Sep. 14-16, Morgantown, West Virginia, Sep. 2005, 19 pages.
(Continued)

*Primary Examiner* — George Gray
(74) *Attorney, Agent, or Firm* — Jeffery R. Peterson

(57) ABSTRACT

A technique includes deploying an untethered object though a passageway of a string in a well; and sensing a property of an environment of the string, an electromagnetic coupling or a pressure as the object is being communicated through the passageway. The technique includes selectively autonomously operating the untethered object in response to the sensing.

6 Claims, 9 Drawing Sheets

(51) Int. Cl.
*E21B 43/14* (2006.01)
*E21B 47/09* (2012.01)
*E21B 34/00* (2006.01)

(58) Field of Classification Search
USPC ..... 166/193, 255.1, 308.1
See application file for complete search history.

(56) References Cited

U.S. PATENT DOCUMENTS 2,374,169 A 4/1945 Martin
2,429,912 A 10/1947 Baker
2,458,278 A 1/1949 Company et al.
2,716,454 A 8/1955 Abendroth
2,962,097 A 11/1960 Dollison
3,011,548 A 12/1961 Holt
3,051,243 A 8/1962 Grimmer et al.
3,054,415 A 9/1962 Baker et al.
3,263,752 A 8/1966 Conrad
3,269,463 A 8/1966 Page, Jr.
3,270,814 A 9/1966 Richardson et al.
3,285,353 A 11/1966 Young
3,306,361 A 2/1967 Lebourg
3,333,635 A 8/1967 Crawford
3,395,758 A 8/1968 Kelly et al.
3,542,127 A 11/1970 Malone
3,741,300 A 6/1973 Jeansonne et al.
3,768,556 A 10/1973 Baker
3,789,926 A 2/1974 Henley et al.
3,942,373 A * 3/1976 Rogers ..... 73/152.56
3,995,692 A 12/1976 Seitz
4,064,937 A 12/1977 Barrington
4,099,563 A 7/1978 Hutchison et al.
4,176,717 A 12/1979 Hix
4,194,561 A 3/1980 Stokley et al.
4,246,968 A 1/1981 Jessup et al.
4,355,686 A 10/1982 Arendt et al.
4,429,747 A 2/1984 Williamson
4,444,266 A 4/1984 Pringle
4,520,870 A 6/1985 Pringle
4,709,760 A 12/1987 Crist et al.
4,729,432 A 3/1988 Helms
4,771,831 A 9/1988 Pringle et al.
4,813,481 A 3/1989 Sproul et al.
4,880,059 A 11/1989 Brandell et al.
4,944,348 A 7/1990 Whiteley et al.
4,949,788 A 8/1990 Szarka et al.
4,967,841 A 11/1990 Murray
4,991,654 A 2/1991 Brandell et al.
4,994,654 A 2/1991 St. Louis
5,029,644 A 7/1991 Szarka et al.
5,048,611 A 9/1991 Cochran
5,183,114 A 2/1993 Mashaw et al.
5,203,412 A 4/1993 Doggett
5,224,044 A 6/1993 Tamura et al.
5,224,556 A 7/1993 Wilson et al.
5,242,022 A 9/1993 Burton et al.
5,295,393 A 3/1994 Thiercelin
5,333,692 A 8/1994 Baugh et al.
5,337,808 A 8/1994 Graham
5,361,856 A 11/1994 Surjaatmadja et al.
5,368,098 A 11/1994 Blizzard et al.
5,375,661 A 12/1994 Daneshy et al.
5,381,862 A 1/1995 Szarka et al.
5,394,941 A 3/1995 Venditto et al.
5,413,173 A 5/1995 Mills et al.
5,425,418 A 6/1995 Arizmendi et al.
5,505,261 A 4/1996 Huber et al.
5,513,703 A 5/1996 Mills et al.
5,526,884 A 6/1996 Lembcke
5,526,888 A 6/1996 Gazewood
5,579,844 A 12/1996 Rebardi et al.
5,598,890 A 2/1997 Richard et al.
5,609,204 A 3/1997 Rebardi et al.
5,660,232 A 8/1997 Reinhardt
5,692,564 A 12/1997 Brooks
5,759,968 A 6/1998 Furutani et al.
5,765,642 A 6/1998 Surjaatmadja
5,848,646 A 12/1998 Huber et al.
5,887,657 A 3/1999 Bussear et al.
5,921,318 A 7/1999 Ross
5,988,285 A 11/1999 Tucker et al.
6,006,838 A 12/1999 Whiteley et al.
6,009,947 A 1/2000 Wilson et al.
6,059,032 A 5/2000 Jones
6,109,372 A 8/2000 Dorel et al.
6,112,809 A 9/2000 Angle
6,155,342 A 12/2000 Oneal et al.
6,186,227 B1 2/2001 Vaynshteyn et al.
6,186,230 B1 2/2001 Nierode
6,206,095 B1 3/2001 Baugh
6,216,785 B1 4/2001 Achee, Jr. et al.
6,220,357 B1 4/2001 Carmichael et al.
6,253,861 B1 7/2001 Carmichael et al.
6,286,599 B1 9/2001 Surjaatmadja et al.
6,302,199 B1 10/2001 Hawkins et al.
6,302,208 B1 10/2001 Walker et al.
6,333,699 B1 12/2001 Zierolf
6,333,700 B1 12/2001 Thomeer et al.
6,334,486 B1 1/2002 Carmody et al.
6,371,208 B1 4/2002 Norman et al.
6,371,221 B1 4/2002 Harrigan et al.
6,378,627 B1 4/2002 Tubel et al.
6,386,109 B1 5/2002 Brooks et al.
6,386,288 B1 5/2002 Snider et al.
6,394,184 B2 5/2002 Tolman et al.
6,431,270 B1 8/2002 Angle
6,443,228 B1 9/2002 Aronstam et al.
6,446,729 B1 9/2002 Bixenman et al.
6,464,006 B2 10/2002 Womble
6,474,419 B2 11/2002 Maier et al.
6,513,595 B1 2/2003 Freiheit et al.
6,520,255 B2 2/2003 Tolman et al.
6,520,258 B1 2/2003 Yang et al.
6,536,524 B1 3/2003 Snider
6,543,538 B2 4/2003 Tolman et al.
6,575,247 B2 6/2003 Tolman et al.
6,634,429 B2 10/2003 Henderson et al.
6,644,412 B2 11/2003 Bode et al.
6,655,461 B2 12/2003 Eslinger et al.
6,662,874 B2 12/2003 Surjaatmadja et al.
6,668,938 B2 12/2003 Sheffield et al.
6,672,405 B2 1/2004 Tolman et al.
6,675,891 B2 1/2004 Hailey, Jr. et al.
6,719,051 B2 4/2004 Hailey et al.
6,719,054 B2 4/2004 Cheng et al.
6,725,933 B2 4/2004 Middaugh et al.
6,725,934 B2 4/2004 Coronado et al.
6,729,416 B2 5/2004 Contreras et al.
6,732,803 B2 5/2004 Garcia et al.
6,759,968 B2 7/2004 Zierolf
6,761,219 B2 7/2004 Snider et al.
6,782,948 B2 8/2004 Echols et al.
6,799,633 B2 10/2004 McGregor
6,808,020 B2 10/2004 Garcia et al.
6,843,317 B2 1/2005 Mackenzie
6,880,402 B1 4/2005 Couet et al.
6,880,638 B2 4/2005 Haughom et al.
6,886,406 B1 5/2005 Couet et al.
6,907,936 B2 6/2005 Fehr et al.
6,951,331 B2 10/2005 Haughom et al.
6,953,094 B2 10/2005 Ross et al.
6,962,215 B2 11/2005 Curtis et al.
6,994,170 B2 2/2006 Echols
6,997,263 B2 2/2006 Campbell et al.
7,021,384 B2 4/2006 Themig
7,066,264 B2 6/2006 Bissonnette et al.
7,066,265 B2 6/2006 Surjaatmadja
7,093,664 B2 8/2006 Todd et al.
7,096,945 B2 8/2006 Richards et al.
7,108,065 B2 9/2006 Bertoja et al.
7,108,067 B2 9/2006 Themig et al.
7,124,831 B2 10/2006 Turley et al.
7,128,152 B2 10/2006 Anyan et al.
7,128,160 B2 10/2006 Anyan et al.

(56) References Cited

U.S. PATENT DOCUMENTS 7,134,505 B2 11/2006 Fehr et al.
7,150,318 B2 12/2006 Freeman
7,165,621 B2 1/2007 Ayoub et al.
7,168,494 B2 1/2007 Starr et al.
7,191,833 B2 3/2007 Richards
7,210,533 B2 5/2007 Starr et al.
7,228,912 B2 6/2007 Patel et al.
7,231,978 B2 6/2007 Rivas et al.
7,322,417 B2 1/2008 Rytlewski et al.
7,325,616 B2 2/2008 Lopez de Cardenas et al.
7,325,617 B2 2/2008 Murray
7,353,879 B2 4/2008 Todd et al.
7,363,967 B2 4/2008 Burris, II et al.
7,377,321 B2 5/2008 Rytlewski
7,385,523 B2 6/2008 Thomeer et al.
7,387,165 B2 6/2008 Lopez de Cardenas et al.
7,395,856 B2 7/2008 Murray
7,431,091 B2 10/2008 Themig et al.
7,464,764 B2 12/2008 Xu
7,467,685 B2 12/2008 Shehab et al.
7,490,669 B2 2/2009 Walker et al.
7,520,333 B2 4/2009 Turner et al.
7,543,634 B2 6/2009 Fehr et al.
7,543,641 B2 6/2009 Contant
7,543,647 B2 6/2009 Walker
7,552,779 B2 6/2009 Murray
7,571,765 B2 8/2009 Themig
7,575,062 B2 8/2009 East, Jr.
7,607,487 B2 10/2009 Lucas et al.
7,640,977 B2 1/2010 Jonas
7,661,481 B2 2/2010 Todd et al.
7,665,535 B2 2/2010 Van Wulfften Palthe
7,681,645 B2 3/2010 McMillin et al.
7,702,510 B2 4/2010 Eide et al.
7,703,507 B2 4/2010 Strickland
7,712,541 B2 5/2010 Loretz et al.
7,735,559 B2 6/2010 Malone
7,748,460 B2 7/2010 Themig et al.
7,814,981 B2 10/2010 Marcu
7,823,637 B2 11/2010 Corbett et al.
7,832,472 B2 11/2010 Themig
7,832,488 B2 11/2010 Guerrero et al.
7,849,925 B2 12/2010 Patel
7,866,396 B2 1/2011 Rytlewski
7,891,774 B2 2/2011 Silverbrook
7,896,088 B2 3/2011 Guerrero et al.
7,909,108 B2 3/2011 Swor et al.
8,091,641 B2 1/2012 Gambier et al.
8,127,654 B2 3/2012 Williams et al.
8,215,411 B2 7/2012 Flores et al.
8,220,543 B2 7/2012 Clark et al.
8,245,782 B2 8/2012 Sanchez
8,272,443 B2 9/2012 Watson et al.
8,276,674 B2 10/2012 Lopez de Cardenas et al.
8,282,365 B2 10/2012 Obrejanu
8,307,902 B2 11/2012 Telfer
8,312,921 B2 11/2012 Gambier et al.
8,403,068 B2 3/2013 Robison et al.
8,453,734 B2 6/2013 Jasek et al.
8,474,523 B2 7/2013 Rayssiguier et al.
8,479,818 B2 7/2013 Rayssiguier et al.
8,490,707 B2 7/2013 Robisson et al.
8,505,632 B2 8/2013 Guerrero et al.
8,511,380 B2 8/2013 Guignard et al.
2001/0045290 A1 11/2001 Pringle et al.
2002/0007949 A1 1/2002 Tolman et al.
2002/0049575 A1 4/2002 Jalali et al.
2002/0074128 A1 6/2002 Allamon et al.
2002/0093431 A1 7/2002 Zierolf
2002/0157837 A1 10/2002 Bode et al.
2002/0158120 A1 10/2002 Zierolf
2002/0166665 A1 11/2002 Vincent et al.
2003/0019634 A1 1/2003 Henderson et al.
2003/0070809 A1 4/2003 Schultz et al.
2003/0070811 A1 4/2003 Robison et al.
2003/0090390 A1 5/2003 Snider et al.
2003/0111224 A1 6/2003 Hailey, Jr. et al.
2003/0127227 A1 7/2003 Fehr et al.
2003/0136562 A1 7/2003 Robison et al.
2003/0180094 A1 9/2003 Madison
2003/0188871 A1 10/2003 Dusterhoft et al.
2003/0234104 A1 12/2003 Johnston et al.
2004/0020652 A1 2/2004 Campbell et al.
2004/0040707 A1 3/2004 Dusterhoft et al.
2004/0050551 A1 3/2004 Jones
2004/0055749 A1 3/2004 Lonnes et al.
2004/0084189 A1 5/2004 Hosie et al.
2004/0092404 A1 5/2004 Murray et al.
2004/0118564 A1 6/2004 Themig et al.
2004/0129422 A1 7/2004 Themig
2004/0231840 A1 11/2004 Ratanasirigulchai et al.
2004/0238168 A1 12/2004 Echols
2004/0262016 A1 12/2004 Farquhar
2005/0178552 A1 8/2005 Fehr et al.
2005/0199401 A1 9/2005 Patel et al.
2005/0205264 A1* 9/2005 Starr et al. ..... 166/376
2005/0230118 A1 10/2005 Noske et al.
2005/0241824 A1* 11/2005 Burris et al. ..... 166/255.1
2005/0279510 A1 12/2005 Patel et al.
2006/0076133 A1 4/2006 Penno
2006/0086497 A1 4/2006 Ohmer et al.
2006/0090893 A1 5/2006 Sheffield
2006/0090906 A1 5/2006 Themig
2006/0108110 A1 5/2006 McKeen
2006/0124310 A1 6/2006 Lopez de Cardenas et al.
2006/0124311 A1 6/2006 Lopez de Cardenas et al.
2006/0124312 A1 6/2006 Rytlewski et al.
2006/0124315 A1 6/2006 Frazier et al.
2006/0144588 A1* 7/2006 Ferguson et al. ..... 166/252.6
2006/0144590 A1 7/2006 Lopez de Cardenas et al.
2006/0157255 A1 7/2006 Smith
2006/0207763 A1 9/2006 Hofman
2006/0207764 A1 9/2006 Rytlewski
2006/0207765 A1 9/2006 Hofman
2006/0243455 A1 11/2006 Telfer et al.
2007/0007007 A1 1/2007 Themig et al.
2007/0044958 A1 3/2007 Rytlewski et al.
2007/0084605 A1 4/2007 Walker et al.
2007/0107908 A1 5/2007 Vaidya et al.
2007/0144746 A1 6/2007 Jonas
2007/0151734 A1 7/2007 Fehr et al.
2007/0181224 A1 8/2007 Marya et al.
2007/0227731 A1 10/2007 Contant
2007/0272411 A1 11/2007 Lopez de Cardenas et al.
2007/0272413 A1 11/2007 Rytlewski et al.
2007/0284097 A1 12/2007 Swor et al.
2008/0000697 A1 1/2008 Rytlewski
2008/0099209 A1 5/2008 Loretz et al.
2008/0105438 A1 5/2008 Jordan et al.
2008/0164027 A1 7/2008 Sanchez
2008/0210429 A1 9/2008 McMillin et al.
2008/0217021 A1 9/2008 Lembcke et al.
2008/0260835 A1 10/2008 Hayes et al.
2009/0056951 A1 3/2009 Mosher et al.
2009/0065194 A1 3/2009 Frazier
2009/0084553 A1 4/2009 Rytlewski et al.
2009/0139726 A1 6/2009 Gomez
2009/0158674 A1 6/2009 Guerrero et al.
2009/0242206 A1 10/2009 Goughnour et al.
2009/0294137 A1 12/2009 Meijer
2010/0006193 A1 1/2010 Kneisl
2010/0024327 A1 2/2010 Kennedy
2010/0065276 A1 3/2010 Fehr et al.
2010/0101803 A1 4/2010 Clayton et al.
2010/0101807 A1 4/2010 Greenlee et al.
2010/0132954 A1 6/2010 Telfer
2010/0139930 A1 6/2010 Patel et al.
2010/0163238 A1 7/2010 Zhan et al.
2010/0209288 A1 8/2010 Marya
2010/0319520 A1 12/2010 Williams et al.
2011/0056692 A1 3/2011 Lopez de Cardenas et al.
2011/0061875 A1 3/2011 Tips et al.
2011/0127047 A1 6/2011 Themig et al.
2011/0146866 A1 6/2011 Jafari Valilou

(56) References Cited

U.S. PATENT DOCUMENTS

| | | | | |
|---|---|---|---|---|
| 2011/0174493 | A1 | 7/2011 | Clem | |
| 2011/0186298 | A1 | 8/2011 | Clark et al. | |
| 2011/0240290 | A1 | 10/2011 | Jasek et al. | |
| 2011/0240301 | A1 | 10/2011 | Robison et al. | |
| 2011/0240311 | A1 | 10/2011 | Robison et al. | |
| 2011/0278010 | A1 | 11/2011 | Fehr et al. | |
| 2011/0284240 | A1* | 11/2011 | Chen et al. | 166/373 |
| 2012/0048559 | A1 | 3/2012 | Ganguly et al. | |
| 2012/0067595 | A1 | 3/2012 | Noske et al. | |
| 2012/0085538 | A1* | 4/2012 | Guerrero et al. | 166/284 |
| 2012/0085548 | A1 | 4/2012 | Fleckenstein et al. | |
| 2012/0090847 | A1 | 4/2012 | Getzlaf et al. | |
| 2012/0097398 | A1 | 4/2012 | Ravensbergen et al. | |
| 2012/0152550 | A1 | 6/2012 | East | |
| 2012/0168152 | A1 | 7/2012 | Casciaro | |
| 2012/0175134 | A1 | 7/2012 | Robisson et al. | |
| 2012/0292032 | A1 | 11/2012 | Themig et al. | |
| 2012/0305265 | A1 | 12/2012 | Garcia et al. | |
| 2012/0312557 | A1 | 12/2012 | King | |
| 2013/0025868 | A1 | 1/2013 | Smith et al. | |
| 2013/0025876 | A1 | 1/2013 | McCoy et al. | |
| 2013/0062055 | A1 | 3/2013 | Tolman et al. | |
| 2013/0067594 | A1 | 3/2013 | Kantor et al. | |
| 2013/0068451 | A1 | 3/2013 | Getzlaf et al. | |
| 2013/0075095 | A1 | 3/2013 | Rayssiguier et al. | |
| 2013/0081827 | A1 | 4/2013 | Etzel | |
| 2013/0092400 | A1 | 4/2013 | Stewart et al. | |
| 2013/0112435 | A1 | 5/2013 | Fleming et al. | |
| 2013/0112436 | A1 | 5/2013 | Fleming et al. | |
| 2013/0161017 | A1 | 6/2013 | King | |
| 2013/0168090 | A1 | 7/2013 | Themig et al. | |
| 2013/0175040 | A1 | 7/2013 | Madero et al. | |
| 2013/0186644 | A1 | 7/2013 | Smith et al. | |
| 2013/0206402 | A1 | 8/2013 | Coon | |
| 2013/0220603 | A1 | 8/2013 | Robison et al. | |
| 2013/0233564 | A1 | 9/2013 | Pacey | |
| 2013/0255939 | A1 | 10/2013 | Kumaran et al. | |
| 2013/0255963 | A1 | 10/2013 | Guerrero et al. | |
| 2013/0312960 | A1 | 11/2013 | Jasek et al. | |
| 2013/0319658 | A1 | 12/2013 | Huh et al. | |
| 2013/0319669 | A1 | 12/2013 | DuPree et al. | |
| 2013/0319687 | A1 | 12/2013 | Huh et al. | |
| 2013/0333883 | A1 | 12/2013 | Ehtesham et al. | |

FOREIGN PATENT DOCUMENTS

| | | | |
|---|---|---|---|
| EP | 2625377 | A2 | 8/2013 |
| GB | 2375558 | A | 11/2002 |
| GB | 2386624 | A | 9/2003 |
| GB | 2411189 | A | 8/2005 |
| GB | 2424233 | A | 9/2006 |
| GC | 0001546 | | 10/2011 |
| MX | 2009002897 | A | 9/2009 |
| WO | 0063520 | A1 | 10/2000 |
| WO | 0107860 | A2 | 2/2001 |
| WO | 0142620 | A1 | 6/2001 |
| WO | 0173423 | A1 | 10/2001 |
| WO | 0192687 | A2 | 12/2001 |
| WO | 03095794 | A1 | 11/2003 |
| WO | 2004088091 | A1 | 10/2004 |
| WO | 2008086165 | A2 | 7/2008 |
| WO | 2010005060 | A1 | 1/2010 |
| WO | 2010112810 | A2 | 10/2010 |
| WO | 2010124371 | A1 | 11/2010 |
| WO | 2011058325 | A2 | 5/2011 |
| WO | 2011126633 | A1 | 10/2011 |
| WO | 2011146866 | A2 | 11/2011 |
| WO | 2012030843 | A2 | 3/2012 |
| WO | 2012045165 | A1 | 4/2012 |
| WO | 2012051705 | A1 | 4/2012 |
| WO | 2012054383 | A2 | 4/2012 |
| WO | 2012083047 | A2 | 6/2012 |
| WO | 2012091926 | A2 | 7/2012 |
| WO | 2012107730 | A2 | 8/2012 |
| WO | 2013028385 | A2 | 2/2013 |
| WO | 2013028801 | A1 | 2/2013 |
| WO | 2013048810 | A1 | 4/2013 |
| WO | 2013053057 | A1 | 4/2013 |
| WO | 2013055516 | A1 | 4/2013 |
| WO | 2012051705 | A9 | 5/2013 |
| WO | 2013070445 | A1 | 5/2013 |
| WO | 2013070446 | A1 | 5/2013 |
| WO | 2013074593 | A1 | 5/2013 |
| WO | 2013106259 | A1 | 7/2013 |
| WO | 2013150304 | A2 | 10/2013 |
| WO | 2013184301 | A1 | 12/2013 |
| WO | 2013184302 | A1 | 12/2013 |

OTHER PUBLICATIONS

Thomson, et al., "Design and Installation of a Cost-Effective Completion System for Horizontal Chalk Wells Where Multiple Zones Require Acid Stimulation", SPE 51177 (a revision of SPE 39150), Offshore Technology Conference, Houston, TX, USA, May 1997.

Lonnes, et al., "Advanced Multizone Stimulation Technology", SPE 95778—SPE Annual Technical Conference and Exhibition, Dallas, Texas, Oct. 9-12, 2005, 7 pages.

Rytlewski, , "Multiple-Layer Completions for Efficient Treatment of Multi-layer Reservoirs", IADC/SPE 112476—IADC/SPE Drilling Conference, Orlando, FL, Mar. 4-6, 2008, 8 pages.

Thomson, et al., "Design and Installation of a Cost-Effective Completion System for Horizontal Chalk Wells Where Multiple Zones Require Acid Stimulation", SPE 51177—Offshore Technology Conference, Houston, Texas, May 2007, pp. 151-156.

International Search Report and Written Opinion mailed on Sep. 27, 2013 for International Patent Application No. PCT/US2013/046071, filed on Jun. 17, 2013, 20 pages total.

* cited by examiner

AUTONOMOUS UNTETHERED WELL OBJECT

BACKGROUND

For purposes of preparing a well for the production of oil or gas, at least one perforating gun may be deployed into the well via a conveyance mechanism, such as a wireline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools. A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an example implementation, a technique includes deploying an untethered object though a passageway of a string in a well; and sensing a property of an environment of the string as the object is being communicated through the passageway. The technique includes selectively autonomously operating the untethered object in response to the sensing.

In another example implementation, a technique includes deploying an untethered object through a passageway of a string in a well; and using the untethered object to sense an electromagnetic coupling as the object is traveling through the passageway. The technique includes selectively autonomously operating the untethered object in response to the sensing.

In another example implementation, a system that is usable with a well includes a string and an untethered object. The untethered object is adapted to be deployed in the passageway such that the object travels in a passageway of the string. The untethered object includes a sensor, an expandable element and a controller. The sensor provides a signal that is responsive to a property of an environment of the string as the object travels in the passageway; and the controller selectively radially expands the element based at least in part on the signal.

In yet another example implementation, a technique includes communicating an untethered object though a passageway of a string in a well; and sensing a pressure as the object is being communicated through the passageway. The technique includes selectively radially expanding the untethered object in response to the sensing.

Advantages and other features will become apparent from the following drawings, description and claims.

DETAILED DESCRIPTION

Figure 1:
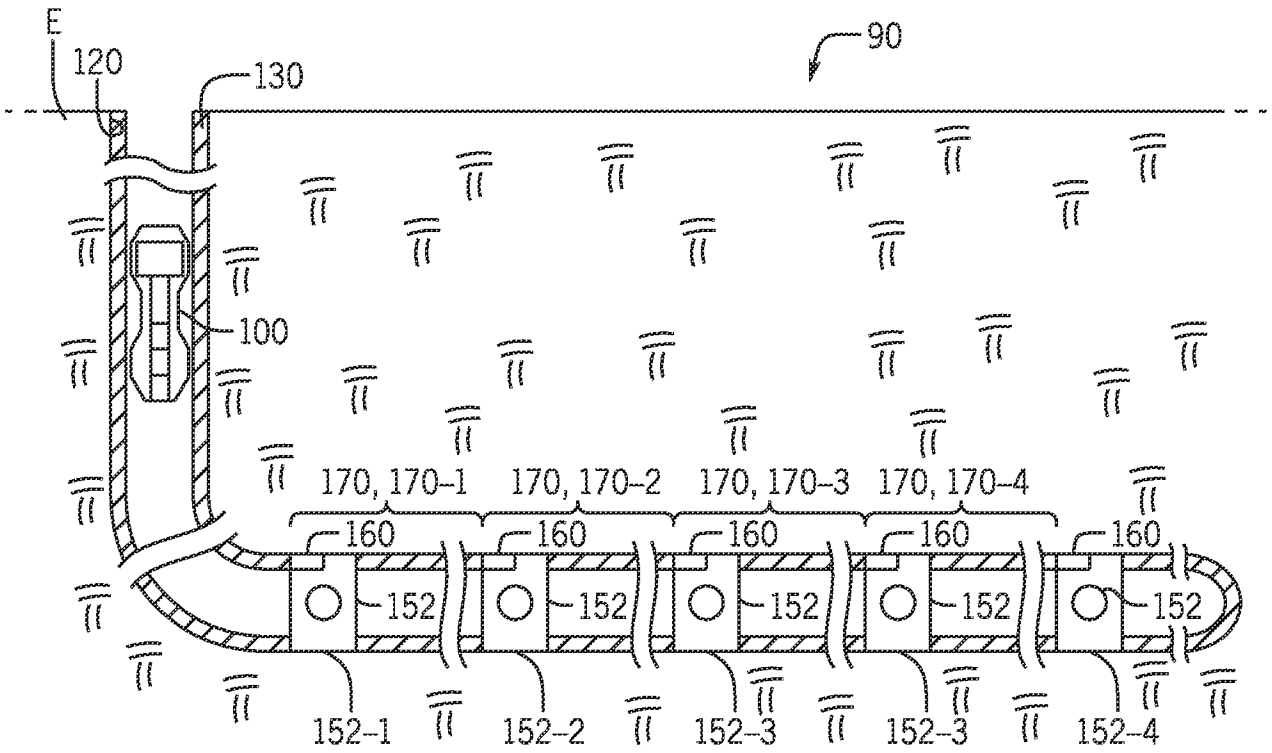
FIG. 1 is a schematic diagram of a multiple stage well according to an example implementation.

In general, systems and techniques are disclosed herein for purposes of deploying an untethered object into a well and using an autonomous operation of the object to perform a downhole operation. In this context, an "untethered object" refers to an object that travels at least some distance in a well passageway without being attached to a conveyance mechanism (a slickline, wireline, coiled tubing string, and so forth). As specific examples, the untethered object may be a dart, a ball or a bar. However, the untethered object may take on different forms, in accordance with further implementations. In accordance with some implementations, the untethered object may be pumped into the well (i.e., pushed into the well with fluid), although pumping may not be employed to move the object in the well, in accordance with further implementations.

In general, the untethered object may be used to perform a downhole operation that may or may not involve actuation of a downhole tool As just a few examples, the downhole operation may be a stimulation operation (a fracturing operation or an acidizing operation as examples); an operation performed by a downhole tool (the operation of a downhole valve, the operation of a single shot tool, or the operation of a perforating gun, as examples); the formation of a downhole obstruction; or the diversion of fluid (the diversion of fracturing fluid into a surrounding formation, for example). Moreover, in accordance with example implementations, a single untethered object may be used to perform multiple downhole operations in multiple zones, or stages, of the well, as further disclosed herein.

In accordance with example implementations, the untethered object is deployed in a passageway (a tubing string passageway, for example) of the well, autonomously senses its position as it travels in the passageway, and upon reaching a given targeted downhole position, autonomously operates to initiate a downhole operation. The untethered object is initially radially contracted when the object is deployed into the passageway. The object monitors its position as the object travels in the passageway, and upon determining that it has reached a predetermined location in the well, the object radially expands. The increased cross-section of the object due to its radial expansion may be used to effect any of a number of downhole operations, such as shifting a valve, forming a fluid obstruction, actuating a tool, and so forth. Moreover, because the object remains radially contracted before reaching the predetermined location, the object may pass through downhole restrictions (valve seats, for example) that may otherwise "catch" the object, thereby allowing the object to be used in, for example, multiple stage applications in which the object is used in conjunction with seats of the same size so that the object selects which seat catches the object.

In general, the untethered object is constructed to sense its downhole position as it travels in the well and autonomously respond based on this sensing. As disclosed herein, the untethered object may sense its position based on features of the string, markers, formation characteristics, and so forth, depending on the particular implementation. As a more specific example, for purposes of sensing its downhole location, the untethered object may be constructed to, during its travel, sense specific points in the well, called "markers" herein. Moreover, as disclosed herein, the untethered object may be constructed to detect the markers by sensing a property of the environment surrounding the object (a physical property of the string or formation, as examples). The markers may be dedicated tags or materials installed in the well for location sensing by the object or may be formed from features (sleeve valves, casing valves, casing collars, and so forth) of the well, which are primarily associated with downhole functions, other than location sensing. Moreover, as disclosed herein, in accordance with example implementations, the untethered object may be constructed to sense its location in other and/or different ways that do not involve sensing a physical property of its environment, such as, for example, sensing a pressure for purposes of identifying valves or other downhole features that the object traverses during its travel.

Referring to FIG. 1, as a more specific example, in accordance with some implementations, a multiple stage well 90 includes a wellbore 120, which traverses one or more formations (hydrocarbon bearing formations, for example). As a more specific example, the wellbore 120 may be lined, or supported, by a tubing string 130, as depicted in FIG. 1. The tubing string 130 may be cemented to the wellbore 120 (such wellbores typically are referred to as "cased hole" wellbores); or the tubing string 130 may be secured to the formation by packers (such wellbores typically are referred to as "open hole" wellbores). In general, the wellbore 120 extends through one or multiple zones, or stages 170 (four stages 170-1, 170-2, 170-3 and 170-4, being depicted as examples in FIG. 1) of the well 90.

It is noted that although FIG. 1 depicts a laterally extending wellbore 120, the systems and techniques that are disclosed herein may likewise be applied to vertical wellbores. In accordance with example implementations, the well 90 may contain multiple wellbores, which contain tubing strings that are similar to the illustrated tubing string 130. Moreover, depending on the particular implementation, the well 90 may be an injection well or a production well. Thus, many variations are contemplated, which are within the scope of the appended claims.

In general, the downhole operations may be multiple stage operations that may be sequentially performed in the stages 170 in a particular direction (in a direction from the toe end of the wellbore 120 to the heel end of the wellbore 120, for example) or may be performed in no particular direction or sequence, depending on the implementation.

Although not depicted in FIG. 1, fluid communication with the surrounding reservoir may be enhanced in one or more of the stages 170 through, for example, abrasive jetting operations, perforating operations, and so forth.

In accordance with example implementations, the well 90 of FIG. 1 includes downhole tools 152 (tools 152-1, 152-2, 152-3 and 152-4, being depicted in FIG. 1 as examples) that are located in the respective stages 170. The tool 152 may be any of a variety of downhole tools, such as a valve (a circulation valve, a casing valve, a sleeve valve, and so forth), a seat assembly, a check valve, a plug assembly, and so forth, depending on the particular implementation. Moreover, the tool 152 may be different tools (a mixture of casing valves, plug assemblies, check valves, and so forth, for example).

A given tool 152 may be selectively actuated by deploying an untethered object through the central passageway of the tubing string 130. In general, the untethered object has a radially contracted state to permit the object to pass relatively freely through the central passageway of the tubing string 130 (and thus, through tools of the string 130), and the object has a radially expanded state, which causes the object to land in, or, be "caught" by, a selected one of the tools 152 or otherwise secured at a selected downhole location, in general, for purposes of performing a given downhole operation. For example, a given downhole tool 152 may catch the untethered object for purposes of forming a downhole obstruction to divert fluid (divert fluid in a fracturing or other stimulation operation, for example); pressurize a given stage 170; shift a sleeve of the tool 152; actuate the tool 152; install a check valve (part of the object) in the tool 152; and so forth, depending on the particular implementation.

For the specific example of FIG. 1, the untethered object is a dart 100, which, as depicted in FIG. 1, may be deployed (as an example) from the Earth surface E into the tubing string 130 and propagate along the central passageway of the string 130 until the dart 100 senses proximity of the targeted tool 152 (as further disclosed herein), radially expands and engages the tool 152. It is noted that the dart 100 may be deployed from a location other than the Earth surface E, in accordance with further implementations. For example, the dart 100 may be released by a downhole tool. As another example, the dart 100 may be run downhole on a conveyance mechanism and then released downhole to travel further downhole untethered.

Although examples are disclosed herein in which the dart 100 is constructed to radially expand at the appropriate time so that a tool 152 of the string 130 catches the dart 100, in accordance with other implementations disclosed herein, the dart 100 may be constructed to secure itself to an arbitrary position of the string 130, which is not part of a tool 152. Thus, many variations are contemplated, which are within the scope of the appended claims.

For the example that is depicted in FIG. 1, the dart 100 is deployed in the tubing string 130 from the Earth surface E for purposes of engaging one of the tool 152 (i.e., for purposes of engaging a "targeted tool 152"). The dart 100 autonomously senses its downhole position, remains radially contracted to pass through tool(s) 152 (if any) uphole of the targeted tool 152, and radially expands before reaching the targeted tool 152. In accordance with some implementations, the dart 100 senses its downhole position by sensing the presence of markers 160 which may be distributed along the tubing string 130.

For the specific example of FIG. 1, each stage 170 contains a marker 160, and each marker 160 is embedded in a different tool 152. The marker 160 may be a specific material, a specific downhole feature, a specific physical property, a radio frequency (RF) identification (RFID), tag, and so forth, depending on the particular implementation.

It is noted that each stage 170 may contain multiple markers 160; a given stage 170 may not contain any markers 160; the markers 160 may be deployed along the tubing string 130 at positions that do not coincide with given tools 152; the markers 160 may not be evenly/regularly distributed as depicted in FIG. 1; and so forth, depending on the particular implementation. Moreover, although FIG. 1 depicts the markers 160 as being deployed in the tools 152, the markers 160 may be deployed at defined distances with respect to the tools 152, depending on the particular implementation. For example, the markers 160 may be deployed between or at intermediate positions between respective tools 152, in accordance with further implementations. Thus, many variations are contemplated, which are within the scope of the appended claims.

In accordance with an example implementation, a given marker 160 may be a magnetic material-based marker, which may be formed, for example, by a ferromagnetic material that is embedded in or attached to the tubing string 130, embedded in or attached to a given tool housing, and so forth. By sensing the markers 160, the dart 100 may determine its downhole position and selectively radially expand accordingly. As further disclosed herein, in accordance with an example implementation, the dart 100 may maintain a count of detected markers. In this manner, the dart 100 may sense and log when the dart 100 passes a marker 160 such that the dart 100 may determine its downhole position based on the marker count.

Thus, the dart 100 may increment (as an example) a marker counter (an electronics-based counter, for example) as the dart 100 traverses the markers 160 in its travel through the tubing string 130; and when the dart 100 determines that a given number of markers 160 have been detected (via a threshold count that is programmed into the dart 100, for example), the dart 100 radially expands.

For example, the dart 100 may be launched into the well 90 for purposes of being caught in the tool 152-3. Therefore, given the example arrangement of FIG. 1, the dart 100 may be programmed at the Earth surface E to count two markers 160 (i.e., the markers 160 of the tools 152-1 and 152-2) before radially expanding. The dart 100 passes through the tools 152-1 and 152-2 in its radially contracted state; increments its marker counter twice due to the detection of the markers 152-1 and 152-2; and in response to its marker counter indicating a "2," the dart 100 radially expands so that the dart 100 has a cross-sectional size that causes the dart 100 to be "caught" by the tool 152-3.

Figure 2:
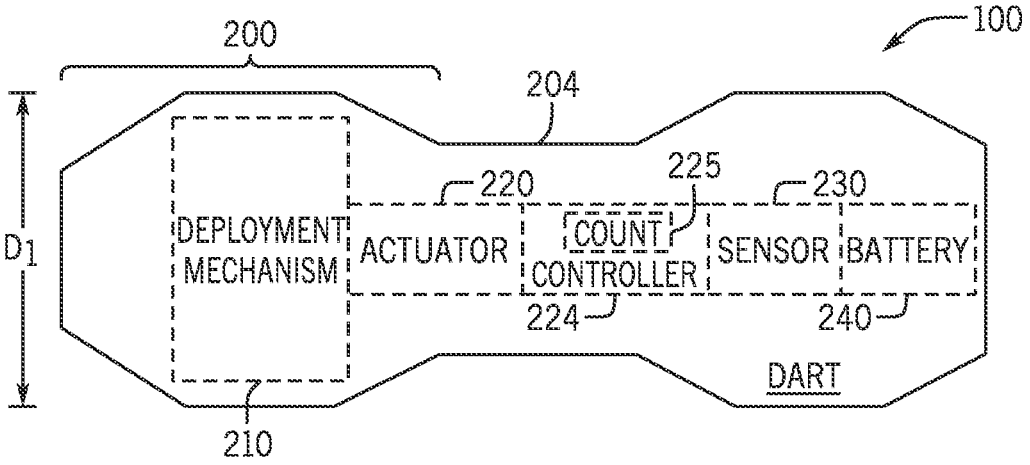
FIG. 2 is a schematic diagram of a dart of FIG. 1 in a radially contracted state according to an example implementation.
Figure 3:
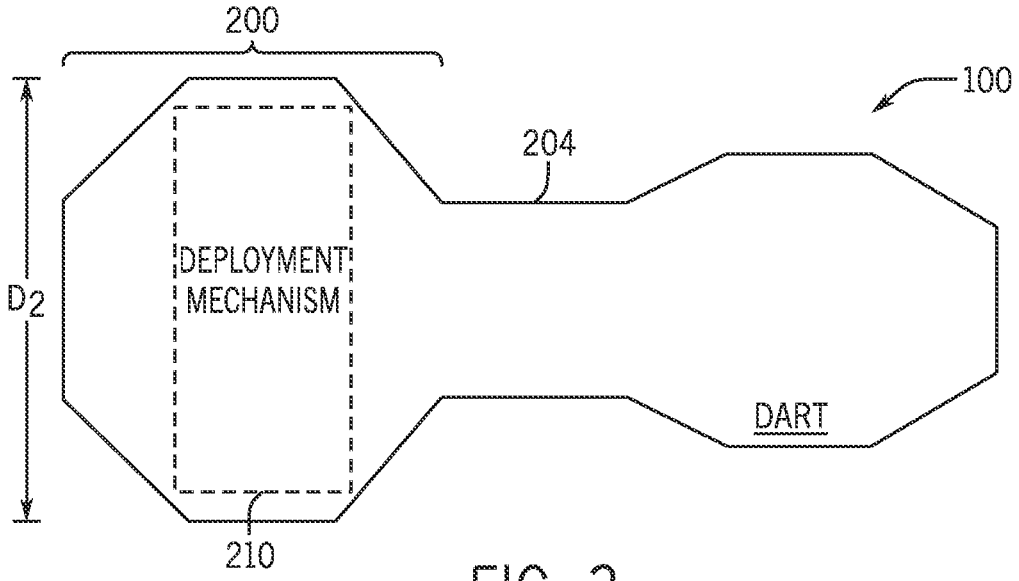
FIG. 3 is a schematic diagram of the dart of FIG. 1 in a radially expanded state according to an example implementation.

Referring to FIG. 2, in accordance with an example implementation, the dart 100 includes a body 204 having a section 200, which is initially radially contracted to a cross-sectional diameter $D_1$ when the dart 100 is first deployed in the well 90. The dart 100 autonomously senses its downhole location and autonomously expands the section 200 to a radially larger cross-sectional diameter $D_2$ (as depicted in FIG. 3) for purposes of causing the next encountered tool 152 to catch the dart 100.

As depicted in FIG. 2, in accordance with an example implementation, the dart 100 include a controller 224 (a microcontroller, microprocessor, field programmable gate array (FPGA), or central processing unit (CPU), as examples), which receives feedback as to the dart's position and generates the appropriate signal(s) to control the radial expansion of the dart 100. As depicted in FIG. 2, the controller 224 may maintain a count 225 of the detected markers, which may be stored in a memory (a volatile or a non-volatile memory, depending on the implementation) of the dart 100.

In this manner, in accordance with an example implementation, the sensor 230 provides one or more signals that indicate a physical property of the dart's environment (a magnetic permeability of the tubing string 130, a radioactivity emission of the surrounding formation, and so forth); the controller 224 use the signal(s) to determine a location of the dart 100; and the controller 224 correspondingly activates an actuator 220 to expand a deployment mechanism 210 of the dart 100 at the appropriate time to expand the cross-sectional dimension of the section 200 from the $D_1$ diameter to the $D_2$ diameter. As depicted in FIG. 2, among its other components, the dart 100 may have a stored energy source, such as a battery 240, and the dart 100 may have an interface (a wireless interface, for example), which is not shown in FIG. 2, for purposes of programming the dart 100 with a threshold marker count before the dart 100 is deployed in the well 90.

The dart 100 may, in accordance with example implementations, count specific markers, while ignoring other markers. In this manner, another dart may be subsequently launched into the tubing string 130 to count the previously-ignored markers (or count all of the markers, including the ignored markers, as another example) in a subsequent operation, such as a remedial action operation, a fracturing operation, and so forth. In this manner, using such an approach, specific portions of the well 90 may be selectively treated at different times. In accordance with some example implementations, the tubing string 130 may have more tools 152 (see FIG. 1), such as sleeve valves (as an example), than are needed for current downhole operations, for purposes of allowing future refracturing or remedial operations to be performed.

In accordance with example implementations, the sensor 230 senses a magnetic field. In this manner, the tubing string 130 may contain embedded magnets, and sensor 230 may be an active or passive magnetic field sensor that provides one or more signals, which the controller 224 interprets to detect the magnets. However, in accordance with further implementations, the sensor 230 may sense an electromagnetic coupling path for purposes of allowing the dart 100 to electromagnetic coupling changes due to changing geometrical features of the string 130 (thicker metallic sections due to tools versus thinner metallic sections for regions of the string 130 where tools are not located, for example) that are not attributable to magnets. In other example implementations, the sensor 230 may be a gamma ray sensor that senses a radioactivity. Moreover, the sensed radioactivity may be the radioactivity of the surrounding formation. In this manner, a gamma ray log may be used to program a corresponding location radioactivity-based map into a memory of the dart 100.

Figure 4:
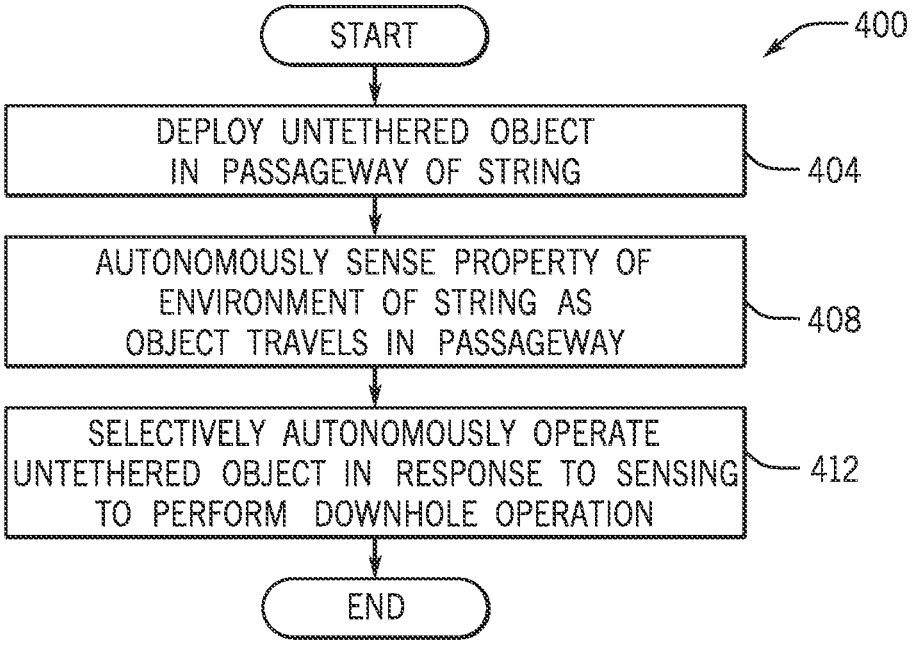
FIG. 4 is a flow diagram depicting a technique to autonomously operate an untethered object in a well to perform an operation in the well according to an example implementation.

Regardless of the particular sensor 230 or sensors 230 used by the dart 100 to sense its downhole position, in general, the dart 100 may perform a technique 400 that is depicted in FIG. 4. Referring to FIG. 4, in accordance with example implementations, the technique 400 includes deploying (block 404) an untethered object, such as a dart, through a passageway of a string and autonomously sensing (block 408) a property of an environment of the string as the object travels in the passageway of the string. The technique 400 includes autonomously controlling the object to perform a downhole function, which may include, for example, selectively radially expanding (block 412) the untethered object in response to the sensing.

Figure 5:
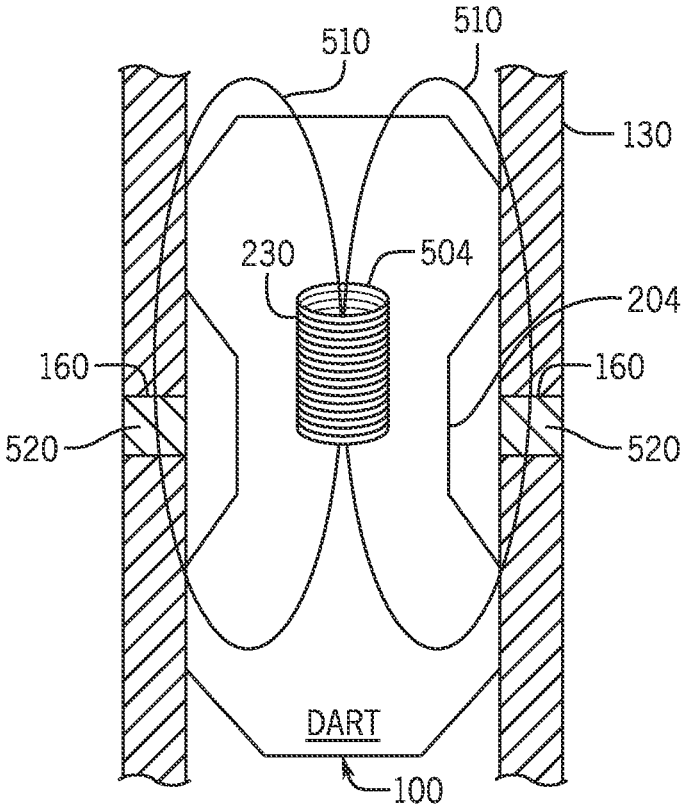
FIG. 5 is a schematic diagram of a dart illustrating a magnetic field sensor of the dart of FIG. 1 according to an example implementation.

Referring to FIG. 5 in conjunction with FIG. 2, in accordance with an example implementation, the sensor 230 of the dart 100 may include a coil 504 for purposes of sensing a magnetic field. In this manner, the coil 504 may be formed from an electrical conductor that has multiple windings about a central opening. When the dart passes in proximity to a ferromagnetic material 520, such as a magnetic marker 160 that contains the material 520, magnetic flux lines 510 of the material 520 pass through the coil 504. Thus, the magnetic field that is sensed by the coil 504 changes in strength due to the motion of the dart 100 (i.e., the influence of the material 520 on the sensed magnetic field changes as the dart 100 approaches the material 520, coincides in location with the material 520 and then moves past the material 520). The changing magnetic field, in turn, induces a current in the coil 504. The controller 224 (see FIG. 2) may therefore monitor the voltage across the coil 504 and/or the current in the coil 504 for purposes of detecting a given marker 160. The coil 504 may or may not be pre-energized with a current (i.e., the coil 504 may passively or actively sense the magnetic field), depending on the particular implementation.

It is noted that FIGS. 2 and 5 depict a simplified view of the sensor 230 and controller 224, as the skilled artisan would appreciate that numerous other components may be used, such as an analog-to-digital converter (ADC) to convert an analog signal from the coil 504 into a corresponding digital value, an analog amplifier, and so forth, depending on the particular implementation.

In accordance with example implementations, the dart 100 may sense a pressure to detect features of the tubing string 130 for purposes of determining the location/downhole position of the dart 100. For example, referring to FIG. 6A, in accordance with example implementations, the dart 100 includes a differential pressure sensor 620 that senses a pressure in a passageway 610 that is in communication with a region 660 uphole from the dart 100 and a passageway 614 that is in communication with a region 670 downhole of the dart 100. Due to this arrangement, the partial fluid seal/obstruction that is introduced by the dart 100 in its radially contracted state creates a pressure difference between the upstream and downstream ends of the dart 100 when the dart 100 passes through a valve.

Figure 6A:
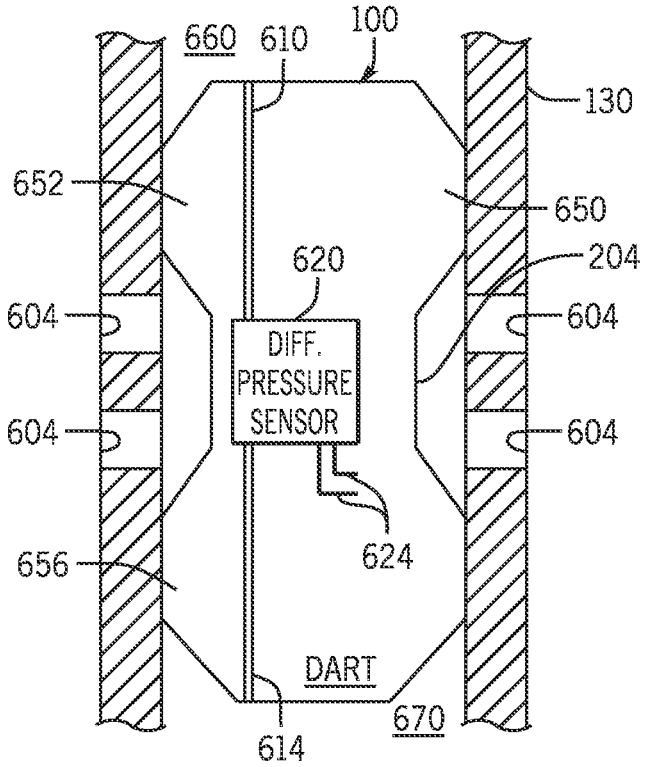
FIG. 6A is a schematic diagram illustrating a differential pressure sensor of the dart of FIG. 1 according to an example implementation.

For example, as shown in FIG. 6A, a given valve may contain radial ports 604. Therefore, for this example, the differential pressure sensor 620 may sense a pressure difference as the dart 100 travels due to a lower pressure below the dart 100 as compared to above the dart 100 due to a difference in pressure between the hydrostatic fluid above the dart 100 and the reduced pressure (due to the ports 604) below the dart 100. As depicted in FIG. 6A, the differential pressure sensor 620 may contain terminals 624 that, for example, electrically indicate the sensed differential pressure (provide a voltage representing the sensed pressure, for example), which may be communicated to the controller 224 (see FIG. 2). For these example implementations, valves of the tubing string 130 are effectively used as markers for purposes of allowing the dart 100 to sense its position along the tubing string 130.

Figure 6B:
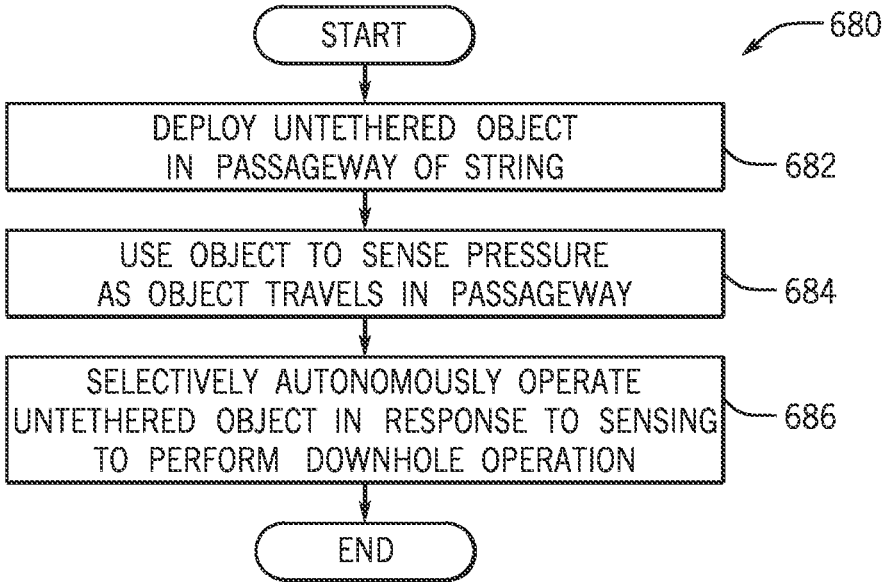
FIG. 6B is a flow diagram depicting a technique to autonomously operate an untethered object in a well to perform an operation in the well according to an example implementation.

Therefore, in accordance with example implementations, a technique 680 that is depicted in FIG. 6B may be used to autonomously operate the dart 100. Pursuant to the technique 680, an untethered object is deployed (block 682) in a passageway of the string; and the object is used (block 684) to sense pressure as the object travels in a passageway of the string. The technique 680 includes selectively autonomously operating (block 686) the untethered object in response to the sensing to perform a downhole operation.

In accordance with some implementations, the dart 100 may sense multiple indicators of its position as the dart 100 travels in the string. For example, in accordance with example implementations, the dart 100 may sense both a physical property and another downhole position indicator, such as a pressure (or another property), for purposes of determining its downhole position. Moreover, in accordance with some implementations, the markers 160 (see FIG. 1) may have alternating polarities, which may be another position indicator that the dart 100 uses to assess/corroborate its downhole position. In this regard, magnetic-based markers 160, in accordance with an example implementation, may be distributed and oriented in a fashion such that the polarities of adjacent magnets alternate. Thus, for example, one marker 160 may have its north pole uphole from its south pole, whereas the next marker 160 may have its south pole uphole from its north pole; and the next the marker 160-3 may have its north pole uphole from its south pole; and so forth. The dart 100 may use the knowledge of the alternating polarities as feedback to verify/assess its downhole position.

Figure 7:
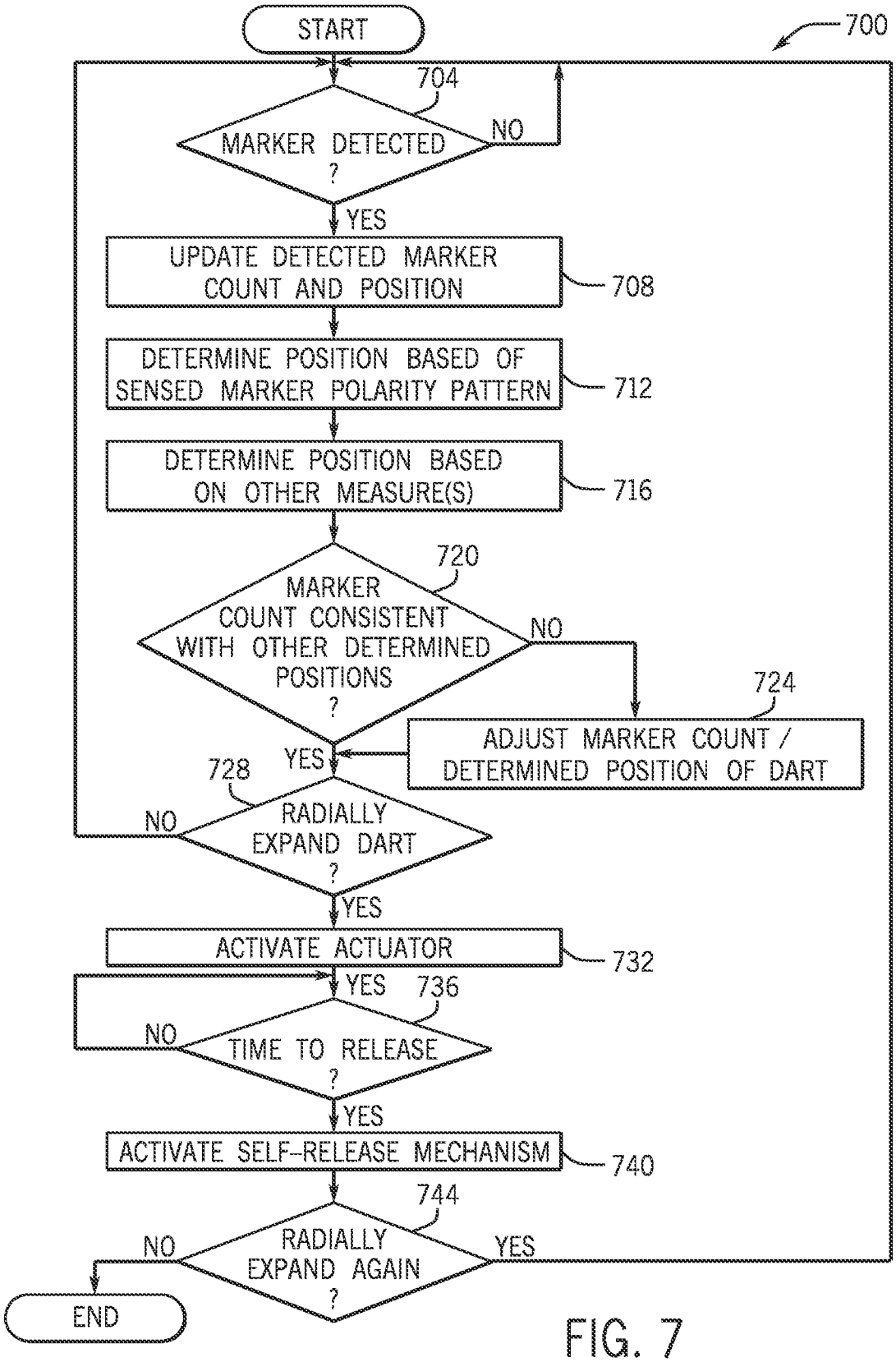
FIG. 7 is a flow diagram depicting a technique to autonomously operate a dart in a well to perform an operation in the well according to an example implementation.

Thus, referring to FIG. 7, in accordance with an example implementation, a technique 700 for autonomously operating an untethered object in a well, such as the dart 100, includes determining (decision block 704) whether a marker has been detected. If so, the dart 100 updates a detected marker count and updates its position, pursuant to block 708. The dart 100 further determines (block 712) its position based on a sensed marker polarity pattern, and the dart 100 may determine (block 716) its position based on one or more other measures (a sensed pressure, for example). If the dart 100 determines (decision block 720) that the marker count is inconsistent with the other determined position(s), then the dart 100 adjusts (block 724) the count/position. Next, the dart 100 determines (decision block 728) whether the dart 100 should radially expand the dart based on determined position. If not, control returns to decision block 704 for purposes of detecting the next marker.

If the dart 100 determines (decision block 728) that its position triggers its radially expansion, then the dart 100 activates (block 732) its actuator for purposes of causing the dart 100 to radially expand to at least temporarily secure the dart 100 to a given location in the tubing string 130. At this location, the dart 100 may or may not be used to perform a downhole function, depending on the particular implementation.

In accordance with example implementations, the dart 100 may contain a self-release mechanism. In this regard, in accordance with example implementations, the technique 700 includes the dart 100 determining (decision block 736) whether it is time to release the dart 100, and if so, the dart 100 activates (block 740) its self-release mechanism. In this manner, in accordance with example implementations, activation of the self-release mechanism causes the dart's deployment mechanism 210 (see FIGS. 2 and 3) to radially contract to allow the dart 100 to travel further into the tubing string 130. Subsequently, after activating the self-release mechanism, the dart 100 may determine (decision block 744) whether the dart 100 is to expand again or whether the dart has reached its final position. In this manner, a single dart 100 may be used to perform multiple downhole operations in potentially multiple stages, in accordance with example implementations. If the dart 100 is to expand again (decision block 744), then control returns to decision block 704.

Figure 8A:
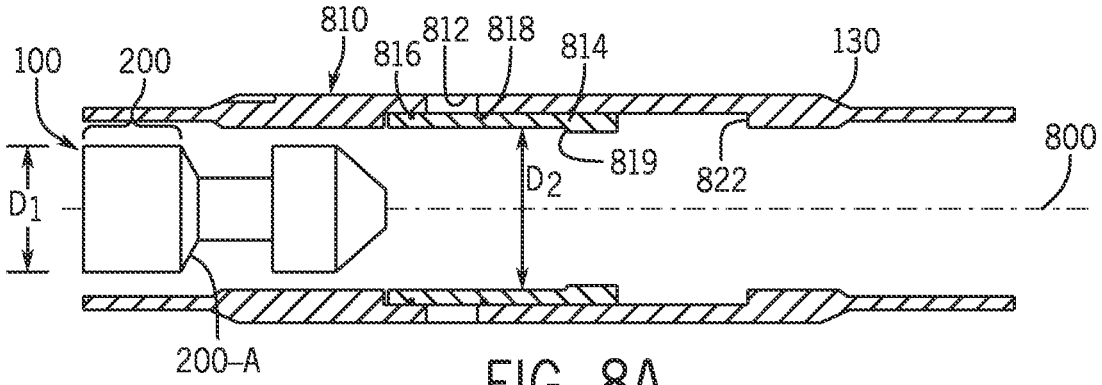
FIGS. 8A and 8B are cross-sectional views illustrating use of the dart to operate a valve according to an example implementation.
Figure 8B:
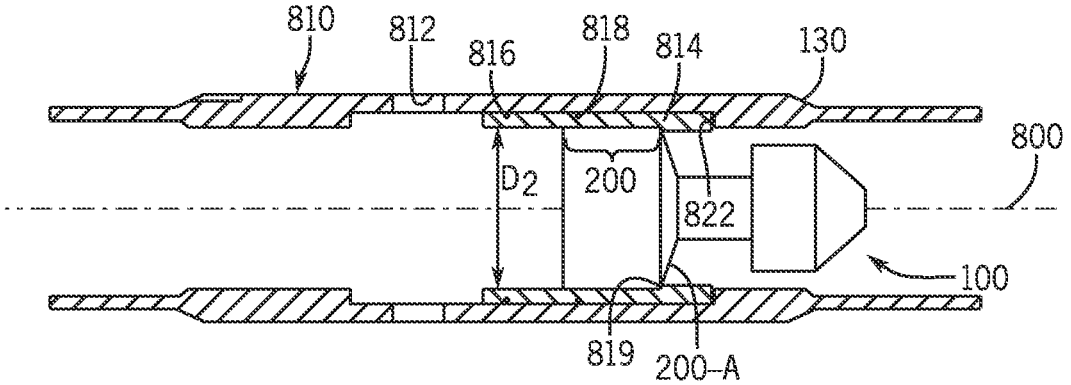

As a more specific example, FIGS. 8A and 8B depict engagement of the dart 100 with a valve assembly 810 of the tubing string 130. As an example, the valve assembly 810 may be a casing valve assembly, which is run into the well 90 closed and which may be opened by the dart 100 for purposes of opening fluid communication between the central passageway of the string 130 and the surrounding formation. For example, communication with the surrounding formation may be established/opened through the valve assembly 810 for purposes of performing a fracturing operation.

In general, the valve assembly 810 includes radial ports 812 that are formed in a housing of the valve assembly 810, which is constructed to be part of the tubing string 130 and generally circumscribe a longitudinal axis 800 of the assembly 810. The valve assembly 810 includes a radial pocket 822 to receive a corresponding sleeve 814 that may be moved along the longitudinal axis 800 for purposes of opening and closing fluid communication through the radial ports 812. In this manner, as depicted in FIG. 8A, in its closed state, the sleeve 814 blocks fluid communication between the central passageway of the valve assembly 810 and the radial ports 812. In this regard, the sleeve 814 closes off communication due to seals 816 and 818 (o-ring seals, for example) that are disposed between the sleeve 814 and the surrounding housing of the valve assembly 810.

As depicted in FIG. 8A, in general, the sleeve 814 has an inner diameter D2, which generally matches the expanded D2 diameter of the dart 100. Thus, referring to FIG. 8B, when the dart 100 is in proximity to the sleeve 814, the dart 100 radially expands the section 200 to close to or at the diameter D2 to cause a shoulder 200-A of the dart 100 to engage a shoulder 819 of the sleeve 814 so that the dart 100 becomes lodged, or caught in the sleeve 814, as depicted in FIG. 8B. Therefore, upon application of fluid pressure to the dart 100, the dart 100 translates along the longitudinal axis 800 to shift open the sleeve 814 to expose the radial ports 812 for purposes of transitioning the valve assembly 810 to the open state and allowing fluid communication through the radial ports 812.

In general, the valve assembly 810 depicted in FIGS. 8A and 8B is constructed to catch the dart 100 (assuming that the dart 100 expands before reaching the valve assembly 810) and subsequently retain the dart 100 until (and if) the dart 100 engages a self-release mechanism.

Figure 9A:
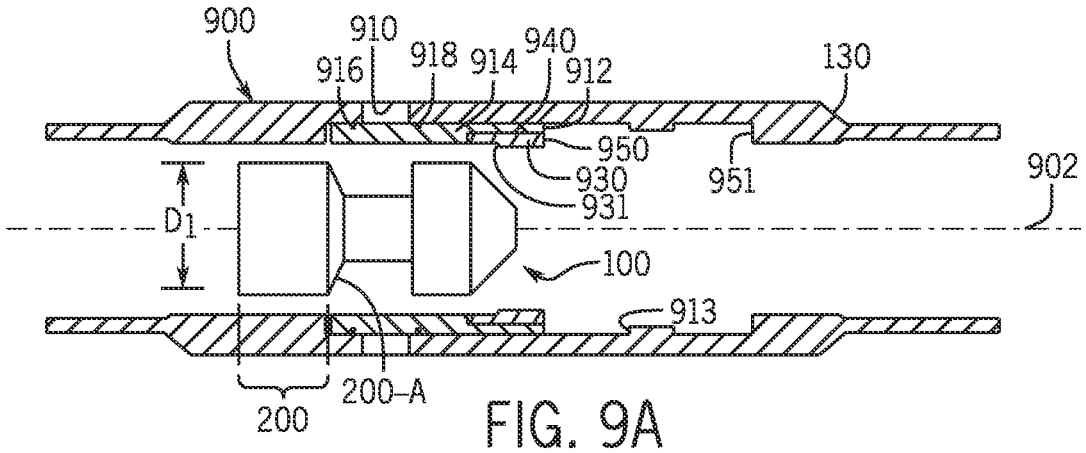
FIGS. 9A and 9B are cross-sectional views illustrating use of the dart to operate a valve that has a mechanism to release the dart according to an example implementation.
Figure 9B:
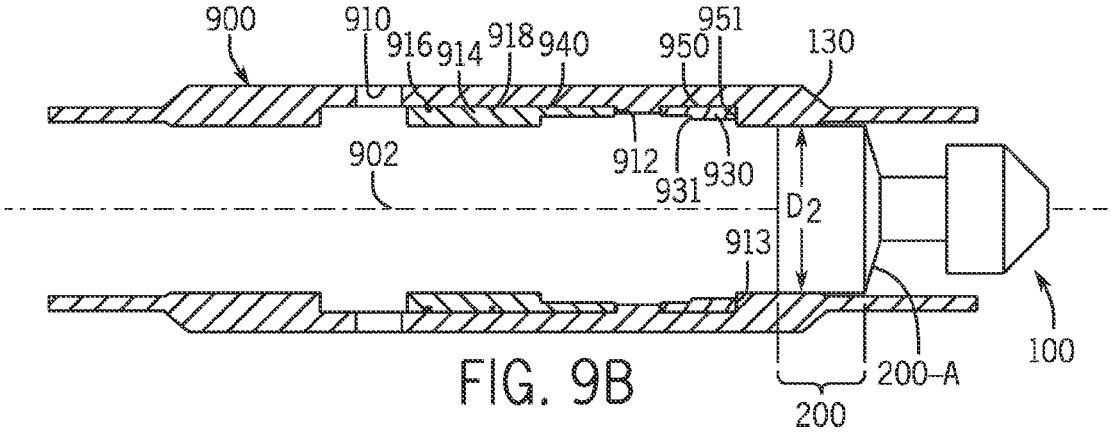

In accordance with some implementations, the valve assembly may contain a self-release mechanism, which is constructed to release the dart 100 after the dart 100 actuates the valve assembly. As an example, FIGS. 9A and 9B depict a valve assembly 900 that also includes radial ports 910 and a sleeve 914 for purposes of selectively opening and closing communication through the radial ports 910. In general, the sleeve 914 resides inside a radially recessed pocket 912 of the housing of the valve assembly 900, and seals 916 and 918 provide fluid isolation between the sleeve 914 and the housing when the valve assembly 900 is in its closed state. Referring to FIG. 9A, when the valve assembly 910 is in its closed state, a collet 930 of the assembly 910 is attached to and disposed inside a corresponding recessed pocket 940 of the sleeve 914 for purposes of catching the dart 100 (assuming that the dart 100 is in its expanded D2 diameter state). Thus, as depicted in FIG. 9A, when entering the valve assembly 900, the section 200 of the dart 100, when radially expanded, is sized to be captured inside the inner diameter of the collet 930 via the shoulder 200-A seating against a stop shoulder 913 of the pocket 912.

The securement of the section 200 of the dart 100 to the collet 930, in turn, shifts the sleeve 914 to open the valve assembly 900. Moreover, further translation of the dart 100 along the longitudinal axis 902 moves the collet 930 outside of the recessed pocket 940 of the sleeve 914 and into a corresponding recessed region 950 further downhole of the recessed region 912 where a stop shoulder 951 engages the collet 930. This state is depicted in FIG. 9B, which shows the collet 930 as being radially expanded inside the recess region 940. For this radially expanded state of the collet 930, the dart 100 is released, and allowed to travel further downhole.

Thus, in accordance with some implementations, for purposes of actuating, or operating, multiple valve assemblies, the tubing string 130 may contain a succession, or "stack," of one or more of the valve assemblies 900 (as depicted in FIGS. 9A and 9B) that have self-release mechanisms, with the very last valve assembly being a valve assembly, such as the valve assembly 800, which is constructed to retain the dart 100.

Figure 10:
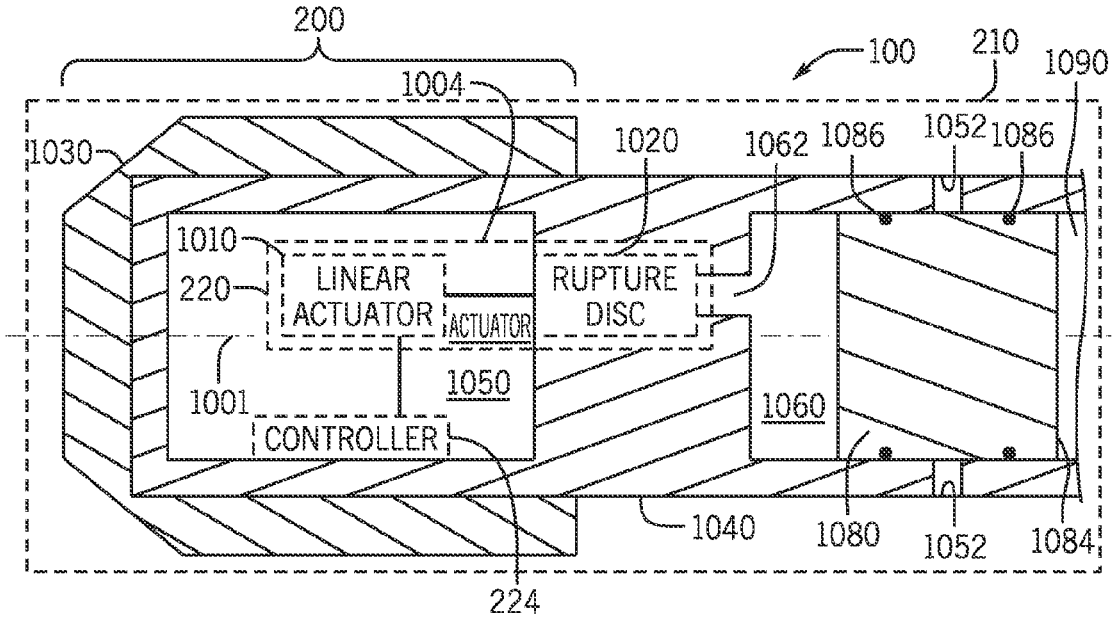
FIG. 10 is a schematic diagram of a deployment mechanism of the dart according to an example implementation.

Referring to FIG. 10, in accordance with example implementations, the deployment mechanism 210 of the dart 100 may be formed from an atmospheric pressure chamber 1050 and a hydrostatic pressure chamber 1060. More specifically, in accordance with an example implementation, a mandrel 1080 resides inside the hydrostatic pressure chamber 1060 and controls the communication of hydrostatic pressure (received in a region 1090 of the dart 100) and radial ports 1052. As depicted in FIG. 10, the mandrel 1080 is sealed to the inner surface of the housing of the dart via (o-rings 1086, for example). Due to the chamber 1050 initially exerting atmospheric pressure, the mandrel 1080 blocks fluid communication through the radial ports 1052.

As depicted in FIG. 10, the deployment mechanism 210 includes a deployment element 1030 that is expanded in response to fluid at hydrostatic pressure being communicated through the radial ports 1052. As examples, the deployment element 1030 may be an inflatable bladder, a packer that is compressed in response to the hydrostatic pressure, and so forth. Thus, many implementations are contemplated, which are within the scope of the appended claims.

For purposes of radially expanding the deployment element 1030, in accordance with an example implementation, the dart 100 includes a valve, such as a rupture disc 1020, which controls fluid communication between the hydrostatic chamber 1060 and the atmospheric chamber 1050. In this regard, pressure inside the hydrostatic chamber 1060 may be derived by establishing communication with the chamber 1060 via one or more fluid communication ports (not shown in FIG. 10) with the region uphole of the dart 100. The controller 224 selectively actuates the actuator 220 for purposes of rupturing the rupture disc 1020 to establish communication between the hydrostatic 1060 and atmospheric 1050 chambers for purposes of causing the mandrel 1080 to translate to a position to allow communication of hydrostatic pressure through the radial ports 1052 and to the deployment element 1030 for purposes of radially expanding the element 1030.

As an example, in accordance with some implementations, the actuator 220 may include a linear actuator 1020, which when activated by the controller 224 controls a linearly operable member to puncture the rupture disc 1020 for purposes of establishing communication between the atmospheric 1050 and hydrostatic 1060 chambers. In further implementations, the actuator 220 may include an exploding foil initiator (EFI) to activate and a propellant that is initiated by the EFI for purposes of puncturing the rupture disc 1020. Thus, many implementations are contemplated, which are within the scope of the appended claims.

In accordance with some example implementations, the self-release mechanism of the dart 100 may be formed from a reservoir and a metering valve, where the metering valve serves as a timer. In this manner, in response to the dart radially expanding, a fluid begins flowing into a pressure relief chamber. For example, the metering valve may be constructed to communicate a metered fluid flow between the chambers 1050 and 1060 (see FIG. 10) for purposes of resetting the deployment element 1030 to a radially contracted state to allow the dart 100 to travel further into the well 90. As another example, in accordance with some implementations, one or more components of the dart, such as the deployment mechanism 1030 (FIG. 10) may be constructed of a dissolvable material, and the dart may release a solvent from a chamber at the time of its radial expansion to dissolve the mechanism 1030.

Figure 11:
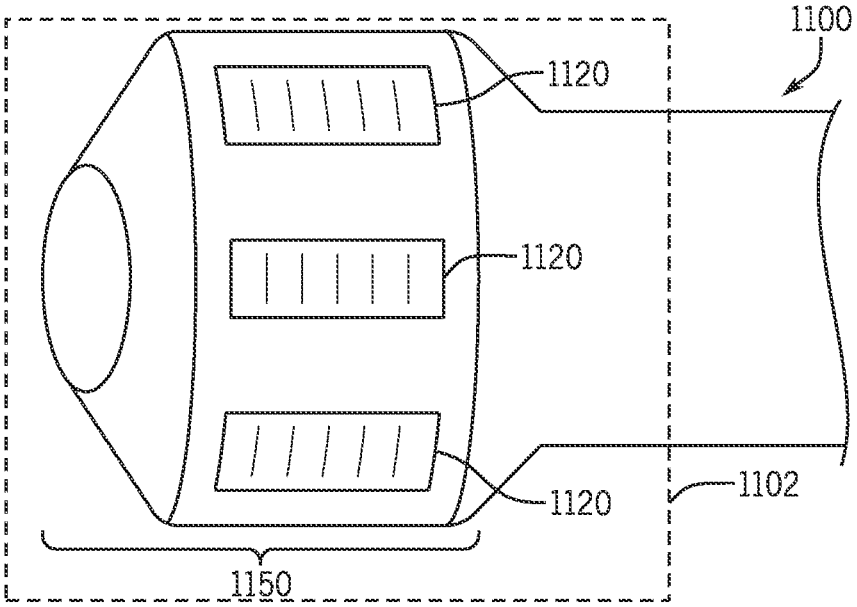
FIG. 11 is a perspective view of a deployment mechanism of the dart according to a further example implementation.

As yet another example, FIG. 11 depicts a portion of a dart 1100 in accordance with another example implementation. For this implementation, a deployment mechanism 1102 of the dart 1100 includes slips 1120, or hardened "teeth," which are designed to be radially expanded for purposes of gripping the wall of the tubing string 130, without using a special seat or profile of the tubing string 130 to catch the dart 1100. In this manner, the deployment mechanism 1102 may contains sleeves, or cones, to slide toward each other along the longitudinal axis of the dart to force the slips 1120 radially outwardly to engage the tubing string 130 and stop the dart's travel. Thus, many variations are contemplated, which are within the scope of the appended claims.

Figure 12:
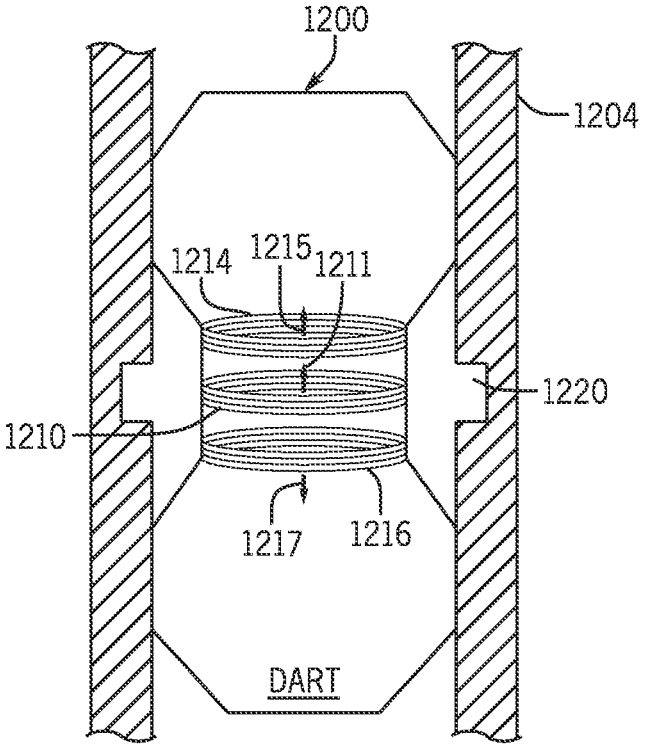
FIG. 12 is a schematic diagram of a dart illustrating an electromagnetic coupling sensor of the dart according to an example implementation.

Other variations are contemplated, which are within the scope of the appended claims. For example, FIG. 12 depicts a dart 1200 according to a further example implementation. In general, the dart 1200 includes an electromagnetic coupling sensor that is formed from two receiver coils 1214 and 1216, and a transmitter coil 1210 that resides between the receiver coils 1215 and 1216. As shown in FIG. 12, the receiver coils 1214 and 1216 have respective magnetic moments 1215 and 1217, respectively, which are opposite in direction. It is noted that the moments 1215 and 1217 that are depicted in FIG. 12 may be reversed, in accordance with further implementations. As also shown in FIG. 12, the transmitter 1210 has an associated magnetic moment 1211, which is pointed upwardly in FIG. 12, but may be pointed downwardly, in accordance with further implementations.

In general, the electromagnetic coupling sensor of the dart 1200 senses geometric changes in a tubing string 1204 in which the dart 1200 travels. More specifically, in accordance with some implementations, the controller (not shown in FIG. 12) of the dart 1200 algebraically adds, or combines, the signals from the two receiver coils 1214 and 1216, such that when both receiver coils 1214 and 1216 have the same effective electromagnetic coupling the signals are the same, thereby resulting in a net zero voltage signal. However, when the electromagnetic coupling sensor passes by a geometrically varying feature of the tubing string 1204 (a geometric discontinuity or a geometric dimension change, such as a wall thickness change, for example), the signals provided by the two receiver coils 1214 and 1216 differ. This difference, in turn, produces a non-zero voltage signal, thereby indicating to the controller that a geometric feature change of the tubing string 1204 has been detected.

Such geometric variations may be used, in accordance with example implementations, for purposes of detecting certain geometric features of the tubing string 1204, such as, for example, sleeves or sleeve valves of the tubing string 1204. Thus, by detecting and possibly counting sleeves (or other tools or features), the dart 1200 may determine its downhole position and actuate its deployment mechanism accordingly.

Figure 13:
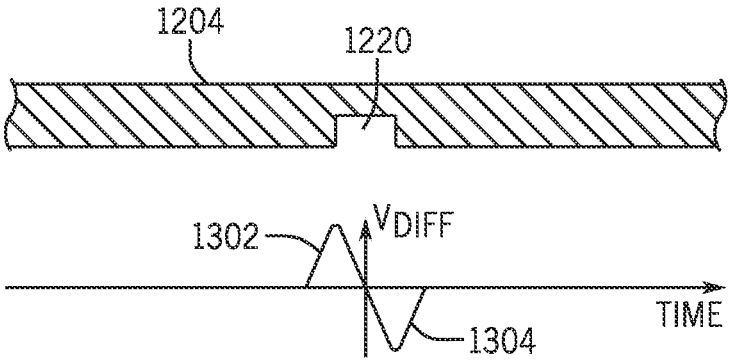
FIG. 13 is an illustration of a signal generated by the sensor of FIG. 12 according to an example implementation.

Referring to FIG. 13 in conjunction with FIG. 12, as a more specific example, an example signal is depicted in FIG. 13 illustrating a signature 1302 of the combined signal (called the "$VD_{IFF}$" signal in FIG. 13) when the electromagnetic coupling sensor passes in proximity to an illustrated geometric feature 1220, such as an annular notch for this example.

Figure 14:
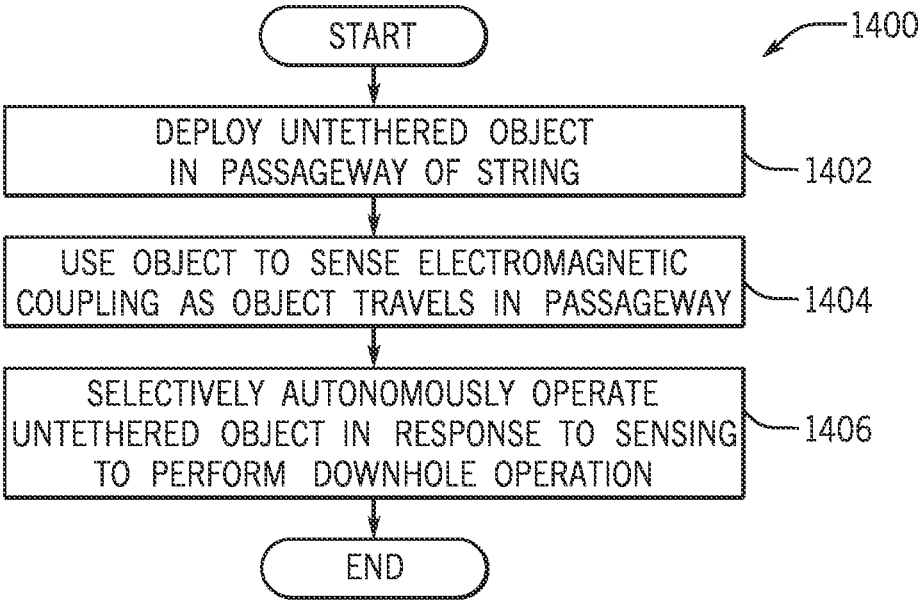
FIG. 14 is a flow diagram depicting a technique to autonomously operate an untethered object in a well to perform an operation in the well according to an example implementation.

Thus, referring to FIG. 14, in accordance with example implementations, a technique 1400 includes deploying (block 1402) an untethered object and using (block 1404) the object to sense an electromagnetic coupling as the object travels in a passageway of the string. The technique 1400 includes selectively autonomously operating the untethered object in response to the sensing to perform a downhole operation, pursuant to block 1406.

Thus, in general, implementations are disclosed herein for purposes of deploying an untethered object through a passageway of the string in a well and sensing a position indicator as the object is being communicated through the passageway. The untethered object selectively autonomously operates in response to the sensing. As disclosed above, the property may be a physical property such as a magnetic marker, an electromagnetic coupling, a geometric discontinuity, a pressure or a radioactive source. In further implementations, the physical property may be a chemical property or may be an acoustic wave. Moreover, in accordance with some implementations, the physical property may be a conductivity. In yet further implementations, a given position indicator may be formed from an intentionally-placed marker, a response marker, a radioactive source, magnet, microelectromechanical system (MEMS), a pressure, and so forth. The untethered object has the appropriate sensor(s) to detect the position indicator(s), as can be appreciated by the skilled artisan in view of the disclosure contained herein.

Other implementations are contemplated and are within the scope of the appended claims. For example, in accordance with further example implementations, the dart may have a container that contains a chemical (a tracer, for example) that is carried into the fractures with the fracturing fluid. In this manner, when the dart is deployed into the well, the chemical is confined to the container. The dart may contain a rupture disc (as an example), or other such device, which is sensitive to the tubing string pressure such that the disc ruptures at fracturing pressures to allow the chemical to leave the container and be transported into the fractures. The use of the chemical in this manner allows the recovery of information during flowback regarding fracture efficiency, fracture locations, and so forth.

As another example of a further implementation, the dart may be contain a telemetry interface that allows wireless communication with the dart. For example, a tube wave (an acoustic wave, for example) may be used to communicate with the dart from the Earth surface (as an example) for purposes of acquiring information (information about the dart's status, information acquired by the dart, and so forth) from the dart. The wireless communication may also be used, for example, to initiate an action of the dart, such as, for example, instructing the dart to radially expand, radially contract, acquire information, transmit information to the surface, and so forth.

While a limited number of examples have been disclosed herein, those skilled in the art, having the benefit of this disclosure, will appreciate numerous modifications and variations therefrom. It is intended that the appended claims cover all such modifications and variations

What is claimed is:

1. A method comprising:

deploying an untethered object through a passageway of a string in a well;

sensing a pressure in the passageway as the object is being communicated through the passageway, wherein sensing a pressure comprises sensing a differential pressure between an uphole end of the untethered object and a downhole end of the untethered object;

determining a position of the object based at least in part on the sensing of the pressure; and selectively autonomously operating the untethered object in response to the determined position.

2. The method of claim 1, wherein selectively autonomously operating the untethered object comprises transitioning the object from a first state to a second state.

3. The method of claim 2, wherein transitioning the object comprises transitioning the object from a radially contracted state to a radially expanded state in response to the sensing.

4. A method comprising:

communicating an untethered object though a passageway of a string in a well;

sensing a pressure as the object is being communicated through the passageway, wherein sensing a pressure comprises sensing a differential pressure between an uphole end of the untethered object and a downhole end of the untethered object; and selectively radially expanding the untethered object in response to the sensing.

5. The method of claim 4, further comprising detecting at least one valve of the string based on the sensing, wherein selectively radially expanding the untethered object further comprises selectively radially expanding the untethered object in response to the detecting.

6. The method of claim 4, wherein sensing the pressure comprises sensing a differential pressure across the object.

* * * * *